US012420980B2

(12) United States Patent
Smith

(10) Patent No.: US 12,420,980 B2
(45) Date of Patent: Sep. 23, 2025

(54) TRAY WITH DIVIDER FEATURES

(71) Applicant: Graphic Packaging International, LLC, Atlanta, GA (US)

(72) Inventor: Jeffrey D. Smith, Solon, OH (US)

(73) Assignee: Graphic Packaging International, LLC, Atlanta, GA (US)

( * ) Notice: Subject to any disclaimer, the term of this patent is extended or adjusted under 35 U.S.C. 154(b) by 97 days.

(21) Appl. No.: 18/128,521

(22) Filed: Mar. 30, 2023

(65) Prior Publication Data

US 2023/0312161 A1 Oct. 5, 2023

Related U.S. Application Data

(60) Provisional application No. 63/411,812, filed on Sep. 30, 2022, provisional application No. 63/326,340, filed on Apr. 1, 2022.

(51) Int. Cl.
*B65D 5/4805* (2006.01)

(52) U.S. Cl.
CPC ..... *B65D 5/48022* (2013.01)

(58) Field of Classification Search
CPC ..... B65D 5/4802; B65D 5/48022; B65D 5/48018; B65D 5/48002
USPC ..... 229/120.16, 120.17, 172, 178
See application file for complete search history.

(56) References Cited

U.S. PATENT DOCUMENTS 499,655 A 6/1893 Clark
642,121 A 1/1900 Hildreth
1,048,577 A 12/1912 Pardoe
1,465,231 A 8/1923 Oglesby
1,471,478 A * 10/1923 Feigelman ..... B65D 5/5206 229/172
1,503,161 A 7/1924 Hornecker
1,634,073 A 6/1927 Labombarde
1,656,919 A 1/1928 Marsh
1,757,475 A 5/1930 Pratt
1,762,704 A 6/1930 Smith
1,901,483 A 3/1933 Ware, Jr.
1,925,102 A 9/1933 Levkoff
1,927,321 A 9/1933 O'Reilly
1,951,408 A 3/1934 Haven
(Continued)

FOREIGN PATENT DOCUMENTS

DE 2 320 190 11/1973
DE 36 27 019 A1 2/1988
(Continued)

OTHER PUBLICATIONS

International Search Report and Written Opinion for PCT/US2023/016838 dated Jul. 7, 2023.

*Primary Examiner* — Nathan J Newhouse
*Assistant Examiner* — Phillip D Schmidt
(74) *Attorney, Agent, or Firm* — FisherBroyles, LLP

(57) ABSTRACT

A tray for holding one or more articles includes a plurality of panels extending at least partially around an interior space of the tray, the plurality of panels comprising a bottom panel, at least one side panel, and at least one end panel, a plurality of end flaps foldably connected to a respective panel of the plurality of panels, and divider features forming a plurality of compartments in the interior space of the tray, the divider features comprising at least one divider panel foldably connected to the bottom panel and at least partially separated from the bottom panel.

38 Claims, 6 Drawing Sheets

(56) References Cited

U.S. PATENT DOCUMENTS 2,000,738 A 5/1935 Benoit
2,027,079 A 1/1936 Weiss
2,054,596 A 9/1936 Ford
2,058,638 A 10/1936 Shapiro
2,141,743 A 12/1938 Ethridge
2,145,430 A 1/1939 New
2,147,563 A 2/1939 Turner
2,152,079 A 3/1939 Mott
2,180,808 A 11/1939 Jacobstein et al.
2,194,220 A 3/1940 Jacobstein et al.
2,196,243 A 4/1940 Bensel
2,290,971 A 7/1942 King
2,330,294 A 9/1943 Leavitt et al.
2,409,692 A 10/1946 Nyberg
2,416,332 A 2/1947 Lehman
2,643,589 A 6/1953 Weiss
2,643,812 A 6/1953 Lange
2,670,123 A * 2/1954 Frankenstein ..... B65D 5/22 229/120.16
2,679,349 A 5/1954 Mullinix
2,688,432 A * 9/1954 Frankenstein ..... B65D 5/2009 229/120.16
2,710,134 A 6/1955 Schroeder et al.
2,743,050 A 4/1956 Crane
2,791,362 A 5/1957 Nute
2,875,938 A 3/1959 Bramhill
2,877,736 A 3/1959 Simmons
2,934,252 A 4/1960 Wickstrom
2,964,230 A * 12/1960 Nemoede ..... B65D 5/4802 229/120.16
3,002,613 A 10/1961 Merkel et al.
3,009,622 A 11/1961 Leone
3,071,882 A 1/1963 Eisman et al.
3,084,790 A 4/1963 Vander Lugt, Jr.
3,090,483 A 5/1963 Altree et al.
3,099,381 A 7/1963 Meyers
3,157,342 A 11/1964 Grady
3,197,115 A 7/1965 Fritz Peter
3,205,603 A 9/1965 Brumley
3,212,636 A * 10/1965 Bennett ..... B65D 5/5021 229/120.16
3,265,283 A 8/1966 Farquhar
3,276,665 A 10/1966 Rasmussen
3,280,968 A 10/1966 Craine
3,434,648 A 3/1969 Du Barry, Jr.
3,653,495 A 4/1972 Gray
3,677,458 A 7/1972 Gosling
3,759,378 A 9/1973 Werth
3,786,914 A 1/1974 Beutler
3,884,348 A 5/1975 Ross
3,935,989 A 2/1976 Naylor
3,958,744 A 5/1976 Herglotz
4,004,691 A 1/1977 Wihksne
4,008,849 A 2/1977 Baber
4,018,378 A 4/1977 Persson
4,055,293 A 10/1977 Stramaglia
4,058,248 A 11/1977 McArdle
4,111,353 A * 9/1978 Collins ..... B65D 5/48012 229/120.16
4,113,100 A 9/1978 Soja et al.
4,192,443 A * 3/1980 McLaren ..... B65D 5/4802 229/120.16
4,260,098 A 4/1981 Manizza et al.
4,265,390 A 5/1981 Faller et al.
4,340,169 A 7/1982 Webinger
4,343,428 A 8/1982 Persson
4,361,265 A 11/1982 Benham
4,470,538 A 9/1984 Heathcock et al.
4,472,896 A 9/1984 Brauner et al.
4,497,433 A 2/1985 Wischusen, III
4,519,538 A 5/1985 Omichi
4,533,079 A 8/1985 Persson
4,558,785 A 12/1985 Gordon
4,586,643 A 5/1986 Halabisky et al.
4,630,733 A 12/1986 Fear
4,684,023 A 8/1987 Cortopassi
4,742,917 A 5/1988 Bornwasser
4,760,952 A 8/1988 Wachter et al.
4,773,541 A 9/1988 Riddell
4,815,609 A 3/1989 Kiedaisch
4,886,160 A 12/1989 Kilgerman
4,901,457 A 2/1990 Chandler
4,905,889 A 3/1990 Schuster
5,012,929 A 5/1991 Roosa
D320,743 S 10/1991 Alexander et al.
5,058,803 A 10/1991 Gulliver
5,085,323 A 2/1992 Kuchenbecker et al.
5,105,950 A 4/1992 Gottfried et al.
RE33,979 E 6/1992 Cortopassi
5,181,650 A 1/1993 Hollander et al.
D342,446 S 12/1993 Parker et al.
D345,272 S 3/1994 Kelso
D346,552 S 5/1994 Krupa
5,368,194 A 11/1994 Oliff et al.
5,419,486 A 5/1995 Bennett et al.
5,662,265 A 9/1997 Jensen
5,690,273 A 11/1997 Jensen
5,697,549 A 12/1997 Yocum
5,699,957 A 12/1997 Blin et al.
5,722,583 A 3/1998 Focke et al.
5,783,030 A 7/1998 Walsh
5,788,117 A 8/1998 Zimmanck
5,826,781 A 10/1998 Jensen
5,842,576 A 12/1998 Snow
5,857,570 A 1/1999 Brown
5,878,947 A 3/1999 Hoy et al.
5,881,884 A 3/1999 Podosek
5,921,398 A 7/1999 Carroll
5,927,498 A 7/1999 Saam
5,979,749 A 11/1999 Bozich
6,015,084 A 1/2000 Mathieu et al.
6,027,018 A 2/2000 Yocum
6,041,997 A 3/2000 Jensen
6,068,181 A 5/2000 Cai
6,102,281 A 8/2000 Lafferty et al.
D431,462 S 10/2000 Menaged et al.
6,129,211 A 10/2000 Prakken et al.
6,135,289 A 10/2000 Miller
6,158,579 A 12/2000 Rosenbaum
6,223,978 B1 5/2001 Drager
6,386,639 B1 5/2002 Yuhas et al.
D458,127 S 6/2002 De Groote
D460,691 S 7/2002 Morris et al.
6,419,152 B1 7/2002 Tokarski
6,435,351 B1 8/2002 Gibb
6,478,159 B1 11/2002 Taylor et al.
D467,499 S 12/2002 Garza et al.
6,510,982 B2 1/2003 White
6,523,692 B2 2/2003 Gregory
D473,787 S 4/2003 Jones, Jr. et al.
6,588,652 B2 7/2003 Cai
D484,043 S 12/2003 Hwang et al.
6,681,983 B2 1/2004 Moore
6,729,475 B2 5/2004 Yuhas et al.
6,834,793 B2 12/2004 Sutherland
6,854,639 B2 2/2005 Walsh
6,913,189 B2 7/2005 Oliff et al.
6,918,487 B2 7/2005 Harrelson
6,923,365 B2 8/2005 Auclair et al.
6,978,892 B2 12/2005 Bansal et al.
7,021,468 B2 4/2006 Cargile, Jr.
7,201,714 B2 4/2007 Zoeckler et al.
7,216,797 B2 5/2007 Lebras
7,225,930 B2 6/2007 Ford et al.
7,270,259 B2 9/2007 Sutherland
7,284,662 B2 10/2007 DeBusk et al.
7,293,652 B2 11/2007 Learn et al.
7,328,834 B2 2/2008 Harrelson
7,398,631 B2 7/2008 Learn
7,398,632 B2 7/2008 Learn et al.
7,416,109 B2 8/2008 Sutherland
8,741,443 B2 6/2014 Hilbish
10,106,291 B2 10/2018 Kearns

(56) References Cited

U.S. PATENT DOCUMENTS

| | | | |
|---|---|---|---|
| 11,059,621 | B2 | 7/2021 | Nowak et al. |
| 2001/0001447 | A1 | 5/2001 | Gregory |
| 2002/0043554 | A1 | 4/2002 | White |
| 2002/0170845 | A1 | 11/2002 | Oliff |
| 2003/0047595 | A1 | 3/2003 | Moore |
| 2004/0074953 | A1 | 4/2004 | Yocum |
| 2004/0099570 | A1 | 5/2004 | Cargile |
| 2005/0092649 | A1 | 5/2005 | Ford et al. |
| 2005/0167291 | A1 | 8/2005 | Sutherland |
| 2005/0199690 | A1 | 9/2005 | Peterson |
| 2005/0218203 | A1 | 10/2005 | Harrelson |
| 2006/0243739 | A1 | 11/2006 | Sherman et al. |
| 2006/0266815 | A1 | 11/2006 | Coltri-Johnson et al. |
| 2007/0000934 | A1 | 1/2007 | Wolpow |
| 2007/0267467 | A1 | 11/2007 | Burke |
| 2007/0267468 | A1 | 11/2007 | Burke |
| 2007/0267471 | A1 | 11/2007 | Falana |
| 2009/0200364 | A1 | 8/2009 | Oliveira |
| 2010/0102111 | A1 | 4/2010 | Learn |
| 2010/0288657 | A1 | 11/2010 | Pinkstone |
| 2011/0253587 | A1 | 10/2011 | Pinkstone |
| 2016/0039562 | A1 | 2/2016 | Given |

FOREIGN PATENT DOCUMENTS

| | | | | |
|---|---|---|---|---|
| DE | 298 17 195 | U1 | 11/1998 | |
| DE | 202 16 854 | U1 | 1/2003 | |
| EP | 0 133 595 | A2 | 2/1985 | |
| EP | 0 704 386 | A1 | 4/1996 | |
| FR | 1.379.931 | | 12/1963 | |
| FR | 2 882 032 | | 8/2006 | |
| FR | 2966131 | A1 * | 4/2012 | ..... B65D 5/0015 |
| GB | 1 218 016 | | 1/1971 | |
| JP | 5-75116 | U | 10/1993 | |
| JP | 3202341 | U | 1/2016 | |
| JP | 2020-132184 | A | 8/2020 | |
| KR | 20-0284781 | Y1 | 8/2002 | |
| KR | 20-0304526 | Y1 | 2/2003 | |
| KR | 20-0390241 | Y1 | 7/2005 | |
| WO | WO 98/31593 | | 7/1998 | |
| WO | WO 03/082686 | A1 | 10/2003 | |
| WO | WO 2004/063031 | A1 | 7/2004 | |
| WO | WO 2005/110866 | A1 | 11/2005 | |

* cited by examiner

TRAY WITH DIVIDER FEATURES

CROSS-REFERENCE TO RELATED APPLICATIONS

The present application claims the benefit of each of U.S. Provisional Patent Application No. 63/326,340, filed on Apr. 1, 2022, and U.S. Provisional Patent Application No. 63/411,812, filed on Sep. 30, 2022.

INCORPORATION BY REFERENCE

The disclosures of each of U.S. Provisional Patent Application No. 63/326,340, filed on Apr. 1, 2022, and U.S. Provisional Patent Application No. 63/411,812, filed on Sep. 30, 2022, are hereby incorporated by reference for all purposes as if presented herein in their entirety.

BACKGROUND OF THE DISCLOSURE

The present disclosure generally relates to containers for holding at least one article. In one embodiment, the present disclosure relates to containers in the form of trays for holding at least one article and that include divider features.

SUMMARY OF THE DISCLOSURE

According to one aspect, the disclosure is generally directed to a tray for holding one or more articles, the tray comprising a plurality of panels extending at least partially around an interior space of the tray, the plurality of panels comprising a bottom panel, at least one side panel, and at least one end panel, a plurality of end flaps foldably connected to a respective panel of the plurality of panels, and divider features forming a plurality of compartments in the interior space of the tray, the divider features comprising at least one divider panel foldably connected to the bottom panel and at least partially separated from the bottom panel.

According to another aspect, the disclosure is generally directed to a blank for forming a tray for holding one or more articles, the blank comprising a plurality of panels for extending at least partially around an interior space of the tray formed from the blank, the plurality of panels comprising a bottom panel, at least one side panel, and at least one end panel, a plurality of end flaps foldably connected to a respective panel of the plurality of panels, and divider features for forming a plurality of compartments in the interior space of the tray formed from the blank, the divider features comprising at least one divider panel foldably connected to the bottom panel and at least partially separable from the bottom panel.

According to another aspect, the disclosure is generally directed to a method of forming a tray for holding one or more articles, the method comprising obtaining a blank comprising a plurality of panels comprising a bottom panel, at least one side panel, and at least one end panel, a plurality of end flaps foldably connected to a respective panel of the plurality of panels, and divider features comprising at least one divider panel foldably connected to the bottom panel and at least partially separably from the bottom panel. The method further comprises positioning the plurality of panels extending at least partially around an interior space of the tray, and at least partially separating the at least one divider panel from the bottom panel to form a plurality of compartments in the interior space of the tray.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Containers according to the present disclosure can accommodate containers of numerous different shapes. In this specification, the terms "lower," "bottom," "upper," "top," "front," and "back" indicate orientations determined in relation to fully erected containers. As described herein, containers may be formed by multiple overlapping panels, portions, and/or end flaps. Such panels, portions, and/or end flaps may be designated in relative terms to one another, e.g., "first", "second", "third", etc., in sequential or non-sequential reference, without departing from the disclosure.

Figure 1:
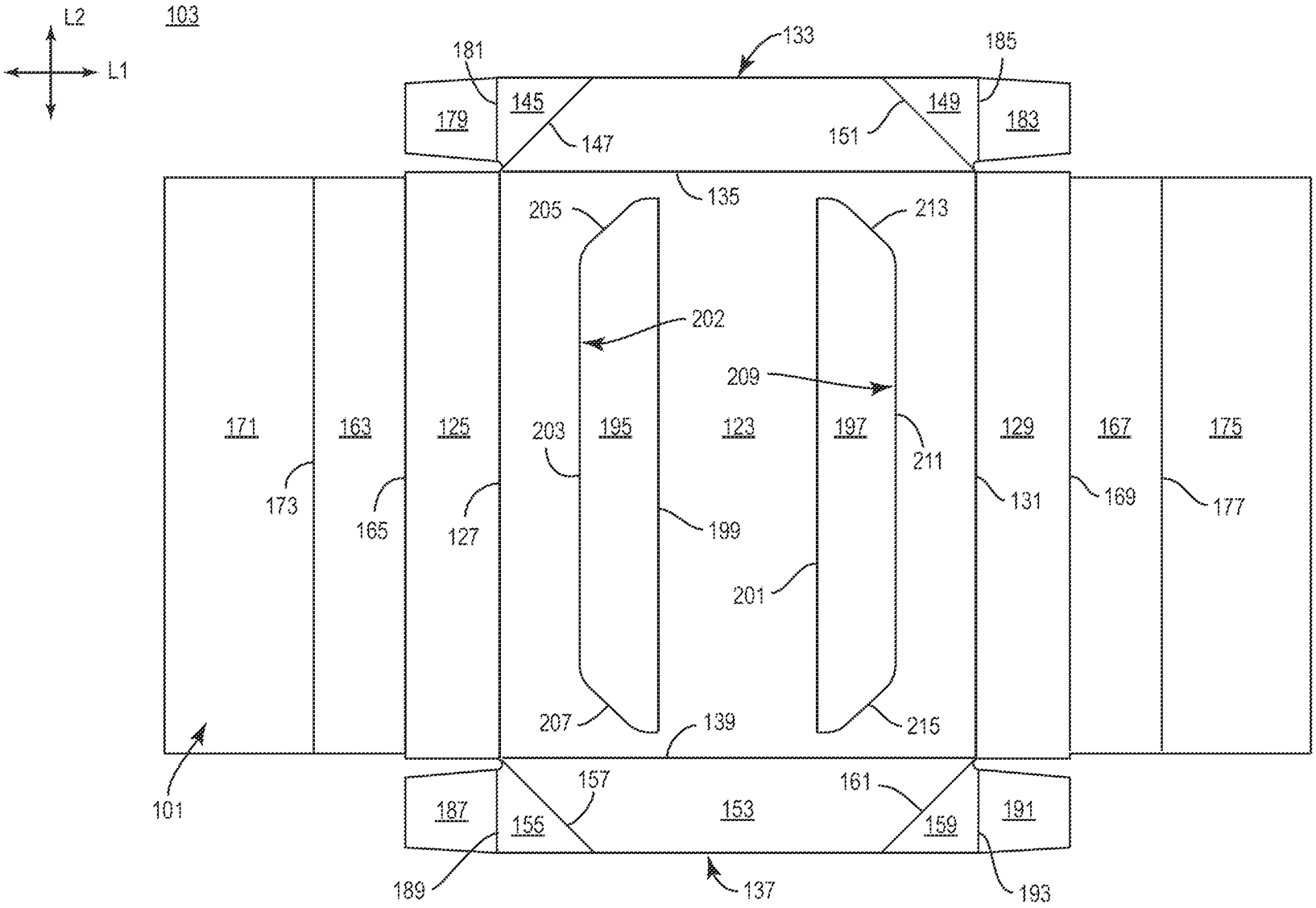
FIG. 1 is a plan view of an exterior surface of a blank for forming a tray according to a first exemplary embodiment of the disclosure.
Figure 2:
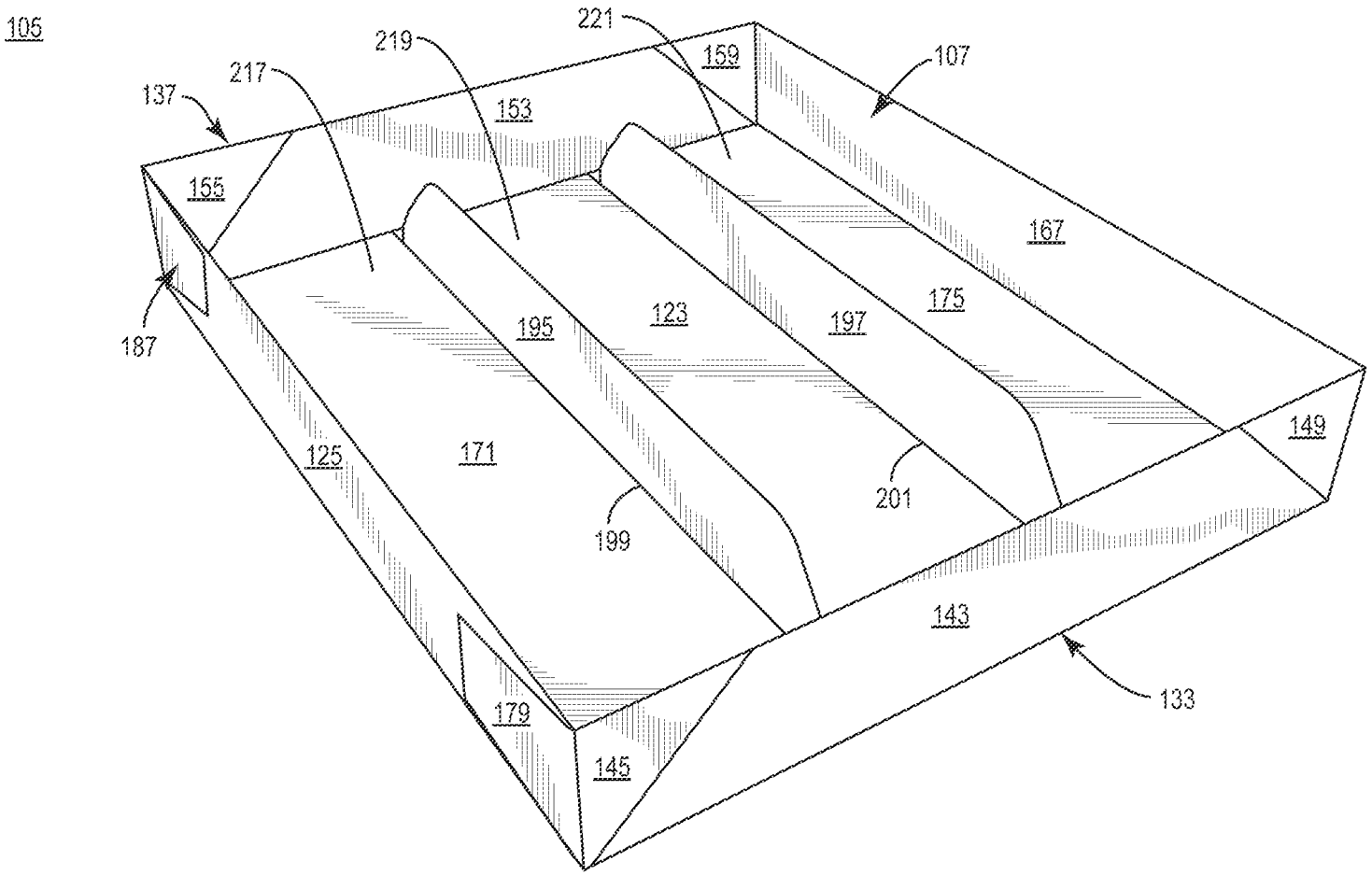
FIG. 2 is a perspective view of a tray formed from the blank of FIG. 1 according to the first exemplary embodiment of the disclosure.

According to a first exemplary embodiment of the disclosure, FIG. 1 illustrates an exterior surface 101 of a blank 103 for forming a container in the form of a tray 105 (FIG. 2). It will be understood that the tray 105 can have a different configuration, for example, a bowl, dish, plate, box, or carton, to name a few.

The tray 105 can be used for holding one or more articles such as food products, e.g., portioned retail food products that can include one or more of cookies, crackers, cakes, pastries, candies, nuts, popcorn, trail mix, gum, etc. In some embodiments, the articles can include frozen or non-frozen food products that can be provided in discrete portions, for example, chicken nuggets, French fries, onion rings, mozzarella sticks, chips, popcorn, other finger foods, etc. In embodiments, other types of articles that can include food products and/or non-food products can be placed in the tray 105 for service to a customer. In some embodiments, such products can be contained in additional packaging and then placed in the tray 105. The tray 105 could be otherwise shaped and arranged and could be used to hold other products and/or articles in similar or different environments without departing from the disclosure.

As shown in FIG. 1, the blank 103 has a lateral axis L1 and a longitudinal axis L2. The blank 103 and tray 105 formed therefrom can include a plurality of panels including a central or bottom panel 123, a first side panel 125 foldably connected to the bottom panel 123 at a lateral fold line 127, a second side panel 129 foldably connected to the bottom panel 123 at a lateral fold line 131, a front panel or first end panel 133 foldably connected to the bottom panel 123 at a longitudinal fold line 135, and a back panel or second end panel 137 foldably connected to the bottom panel 123 at a longitudinal fold line 139.

As shown, the first end panel 133 can include a central portion 143 foldably connected to the bottom panel 123 at the longitudinal fold line 135, a corner portion 145 foldably connected to the central portion 143 of the first end panel 133 at an oblique fold line 147, and a corner portion 149 foldably connected to the central portion 143 of the first end panel 133 at an oblique fold line 151.

Similarly, the second end panel 137 can include a central portion 153 foldably connected to the bottom panel 123 at the longitudinal fold line 139, a corner portion 155 foldably connected to the central portion 153 of the second end panel 137 at an oblique fold line 157, and a corner portion 159 foldably connected to the central portion 153 of the second end panel 137 at an oblique fold line 161.

A first side reinforcement panel 163 can be foldably connected to the first side panel 125 at a lateral fold line 165, and, similarly, a second side reinforcement panel 167 can be foldably connected to the second side panel 129 at a lateral fold line 169.

The blank 103 can also include a plurality of end flaps foldably connected to a respective panel of the plurality of panels. In the illustrated embodiment, the plurality of end flaps can include a first side end flap 171 foldably connected to the first side reinforcement panel 163 at a lateral fold line 173 and a second side end flap 175 foldably connected to the second side reinforcement panel 167 at a lateral fold line 177. In some embodiments, one or both of the side end flaps 171, 175 can be considered bottom reinforcement panels of the blank 103 and tray 105 formed therefrom.

A corner flap or side end flap 179 can be foldably connected to the corner portion 145 of the first end panel 133 at a lateral fold line 181 and a corner flap or side end flap 183 can be foldably connected to the corner portion 149 of the first end panel 133 at a lateral fold line 185. Similarly, a corner flap or side end flap 187 can be foldably connected to the corner portion 155 of the second end panel 137 at a lateral fold line 189 and a corner flap or side end flap 191 can be foldably connected to the corner portion 159 of the second end panel 137 at a lateral fold line 193.

The blank 103 can also include partition features or divider features for forming at least one partition or divider of the tray 105. In the illustrated embodiment, the divider features can include at least one of a pair of divider flaps or divider panels 195, 197 (broadly, respective "first divider flap" and "second divider flap") foldably connected to the bottom panel 123 at a respective lateral fold line 199, 201. The divider panel 195 can be at least partially defined by a cut 202 extending from one endpoint of the fold line 199 to the other endpoint of the fold line 199 and having a central portion 203 intersecting a pair of curved and/or angled end portions 205, 207 each extending to a respective endpoint of the fold line 199.

Similarly, the divider panel 197 can be at least partially defined by a cut 209 extending from one endpoint of the fold line 201 to the other endpoint of the fold line 201 and having a central portion 211 intersecting a pair of curved and/or angled end portions 213, 215 each extending to a respective endpoint of the fold line 201.

It will be understood that the divider features of the blank 103/tray 105 can include one or more other portions of the blank 103/105, for example, one or both of the end flaps 171, 175 and/or one or both of the reinforcement panels 163, 167. In some embodiments, the blank 103/tray 105 can include a different number and/or arrangement of divider features, for example, a different number and/or arrangement of divider flaps.

It will be understood that one or more portions of the blank 103 and tray 105 formed therefrom can include a different number, arrangement, and/or configuration of panels, end flaps, and portions than illustrated and described above. In some embodiments, the first side reinforcement panel 163 and the first side panel 125 can be considered portions (e.g., a base portion and a distal portion) of a single panel, and/or the second side reinforcement panel 167 and the second side panel 129 can be considered portions of a single panel. In some embodiments, the first side reinforcement panel 163, the first side panel 125, and the end flap 171 can be considered portions (e.g., a base portion, a central portion, and a distal portion) of a single panel or single end flap, and/or the second side reinforcement panel 167, the second side panel 129, and the end flap 175 can be considered portions of a single panel or single end flap. In some embodiments, one or both of the end panels 133, 137 can be considered end flaps.

Turning now to FIG. 2, formation of the tray 105 from the blank 103 according to an exemplary of the disclosure will be described.

The blank 103 can be inverted, e.g., positioned with the exterior surface 101 on a supporting surface and with an interior surface facing upwardly. The reinforcement panel 163 can be folded at the fold line 165 into at least partial face-to-face contact with the side panel 125 and such that the end flap 171 is carried into at least partial face-to-face contact with a respective portion of the bottom panel 123. The reinforcement panel 167 can also be folded at the fold line 169 into at least partial face-to-face contact with the side panel 129 and such that the end flap 175 is carried into at least partial face-to-face contact with a respective portion of the bottom panel 123.

The overlapped side panel 125 and reinforcement panel 163 can be folded at the respective aligned fold lines 127, 165 to position the reinforcement panel 163 in at least partial face-to-face contact with a respective portion of the end flap 171, and such that the side panel 125 is positioned facing upwardly.

Similarly, the overlapped side panel 129 and reinforcement panel 167 can be folded at the respective aligned fold lines 131, 169 to position the reinforcement panel 169 in at least partial face-to-face contact with a respective portion of the end flap 175, and such that the side panel 129 is positioned facing upwardly.

Simultaneously or thereafter, the corner portion 145 of the end panel 133 can be folded at the fold line 147 such that the end flap 179 is carried into at least partial face-to-face contact with a respective portion of the side panel 125. The corner portion 149 of the end panel 133 can be folded at the fold line 151 into at least partial face-to-face contact with a respective portion of the side panel 129.

Similarly, the corner portion 155 of the end panel 137 can be folded at the fold line 157 such that the end flap 187 is carried into at least partial face-to-face contact with a respective portion of the side panel 125, and the corner portion 159 of the end panel 137 can be folded at the fold line 161 such that the end flap 191 is carried into at least partial face-to-face contact with a respective portion of the side panel 129. Such an arrangement of the end panels 133, 137 and end flaps 179, 183, 187, 191 can be at least partially maintained with one or more applications of an adhesive such as glue. For example, in some embodiments, one or more applications of an adhesive such as glue can be provided to an interior surface of the end flaps 179, 183, 187, 191.

The aforementioned arrangement of panels, end flaps, and portions can provide a collapsed or shipping configuration of the tray 105, for example, to minimize space during shipping or storage. In this regard, a plurality of trays 105 may be provided in a stacked arrangement in the collapsed or shipping configuration.

The tray 105 can be reconfigured or transitioned from the collapsed configuration to an erected configuration in which the side panels 125, 129 and the end panels 133, 137 are positioned in general upright and perpendicular relation relative to the bottom panel 123. In such arrangement, the side panels 125, 129 are positioned in generally spaced in parallel relation, the end panels 133, 137 are positioned in generally spaced and parallel relation, and each of the side panels 125, 129 is positioned in perpendicular relation to each of the end panels 133, 137. Such an arrangement of the tray 105 provides an interior space 107 about which the panels 123, 125, 129, 133, 137 extend.

Such transition can include folding one or more of the side panels 125, 129 and the end panels 133, 137 upwardly and outwardly relative to the bottom panel 123 at the respective fold lines 127, 131, 135, 139. Due to the attachment of the end panel 133 to the side panels 125, 129 via the respective end flaps 179, 183 and the attachment of the end panel 137 to the side panels 125, 129 via the respective end flaps 187, 191, the manipulation of one or more of the panels 125, 129, 133, 137 can cause movement of one or more respective attached panels.

With continued reference to FIGS. 1 and 2, the divider features of the tray 105 can be activated/engaged by separating the divider panels 195, 197 from the bottom panel 123 at the respective cuts 202, 209 and folding the divider panels 195, 197 upwardly relative to the bottom panel 123 at the respective fold lines 199, 201.

As shown, the upright arrangement of the divider panels 195, 197 at least partially separated from and extending from the bottom panel 123 and their relative arrangement in the interior space 107 of the tray 105 provides a plurality of compartments for separately holding one or more articles therein. In the illustrated embodiment, a first compartment 217 can be at least partially defined between the divider panel 195 and the panels 125, 163, a second compartment 219 can be at least partially defined between the divider panels 195, 197, and a third compartment 221 can be at least partially defined between the divider panel 197 and the panels 129, 167. In this regard, a desired number of compartments can be provided in the interior 107 of the tray 105 by the selective positioning and arrangement of the divider panels 195, 197.

Such an arrangement of the tray 105 can be at least partially maintained, for example, via frictional engagement of a free edge of one or both of the end flaps 171, 175 with a respective upstanding divider panel 195, 197.

In some embodiments, in which only a pair of compartments in the interior space 107 of the tray 105 is desired, one of the divider panels 195, 197 can be folded upwardly relative to the bottom panel 123, and the other of the divider panels 195, 197 can remain in generally coplanar relation with the bottom panel 123.

Figure 3:
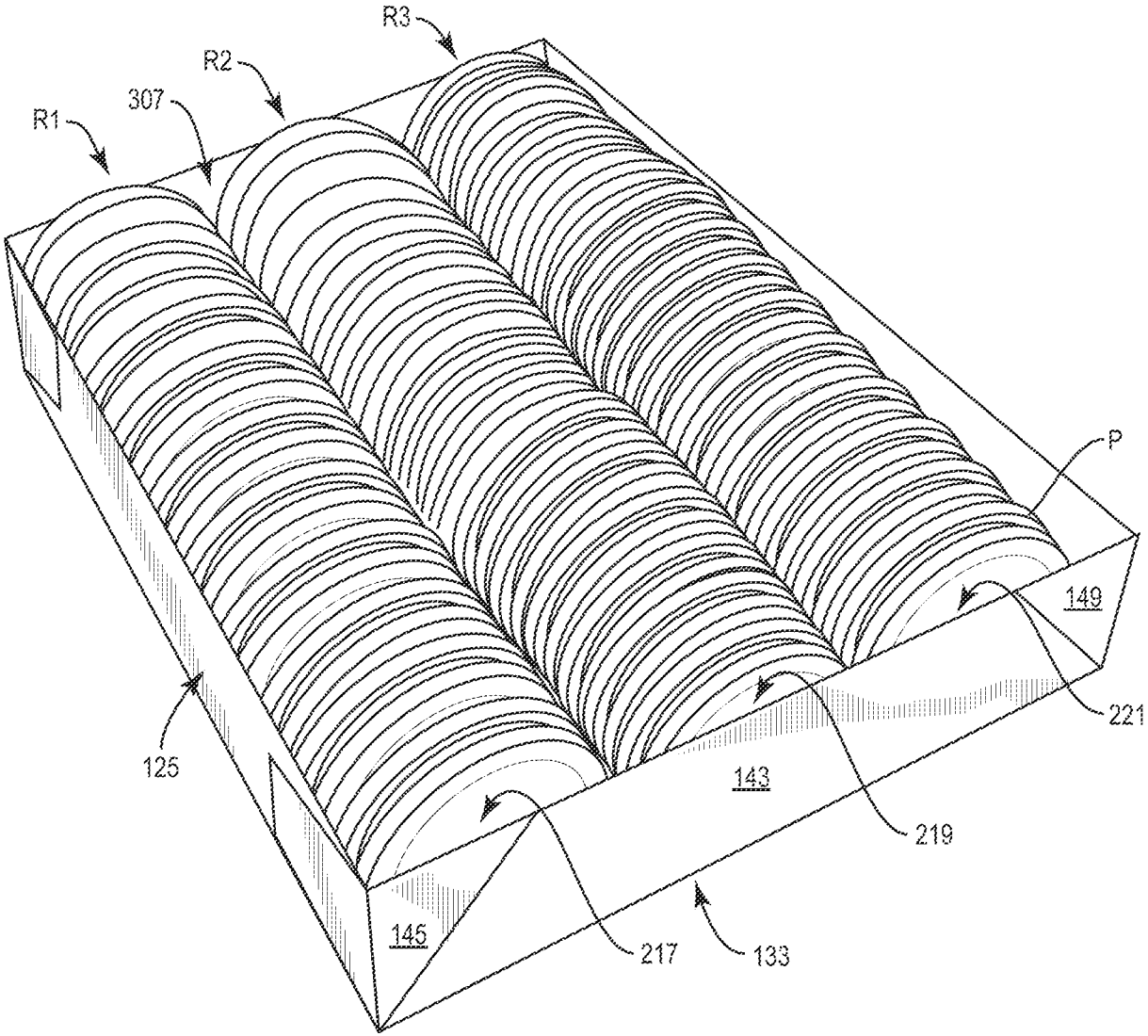
FIG. 3 is a perspective view of the tray of FIG. 2 including a plurality of food products.

Referring additionally to FIG. 3, a plurality of articles P can be positioned in the interior space 107 of the tray 105, for example, for display and/or sale in a retail location. In the illustrated embodiment, a series of articles P can be provided in a row R1 in the first compartment of 217 of the tray 105, a series of articles P can be provided in a row R2 in the second compartment 219 of the tray 105, and a series of articles P can be provided in a row R3 in the third compartment 221 of the tray 105.

While the articles P are illustrated as cookies or other food products having a generally uniform appearance, it will be understood that a different configuration (e.g., flavor, color, filling, etc.) of such product can be separated in the different compartments of the tray 105 and/or different articles altogether can be separated in such compartments.

The aforementioned blank 103 and tray 105 formed therefrom provides a robust construction and versatile arrangement thereof that can accommodate articles of different types and/or properties, separated into different compartments. In some embodiments, the blank 103/tray 105 can be devoid of plastic or other polymeric materials to provide such divider features to increase sustainability of the products, reduce landfill impact, increase biodegradability, etc. In this regard, the blank 103/tray 105 can be comprised of paperboard or other composite material.

Figure 4:
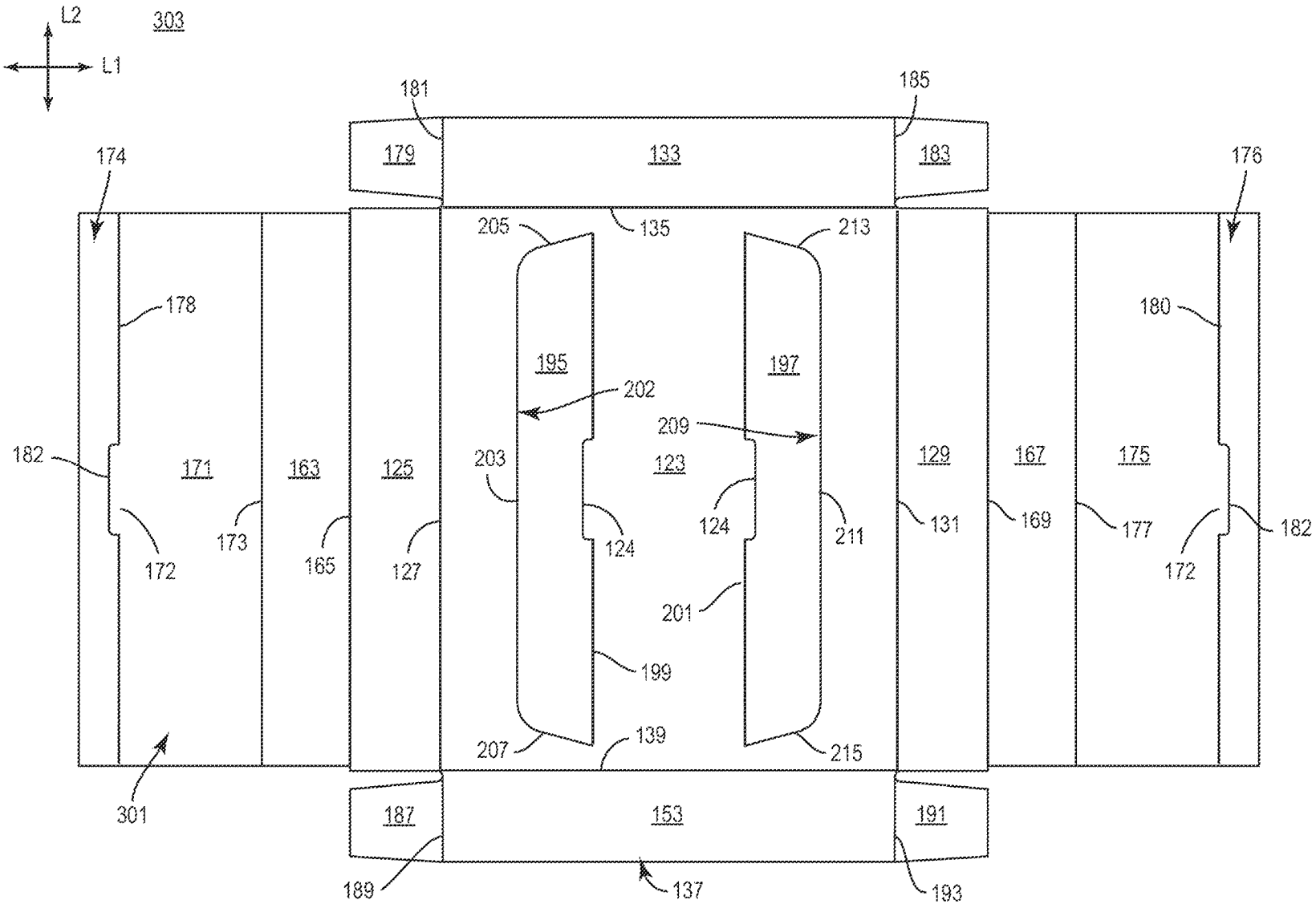
FIG. 4 is a plan view of an exterior surface of a blank for forming a tray according to a second exemplary embodiment of the disclosure.
Figure 5:
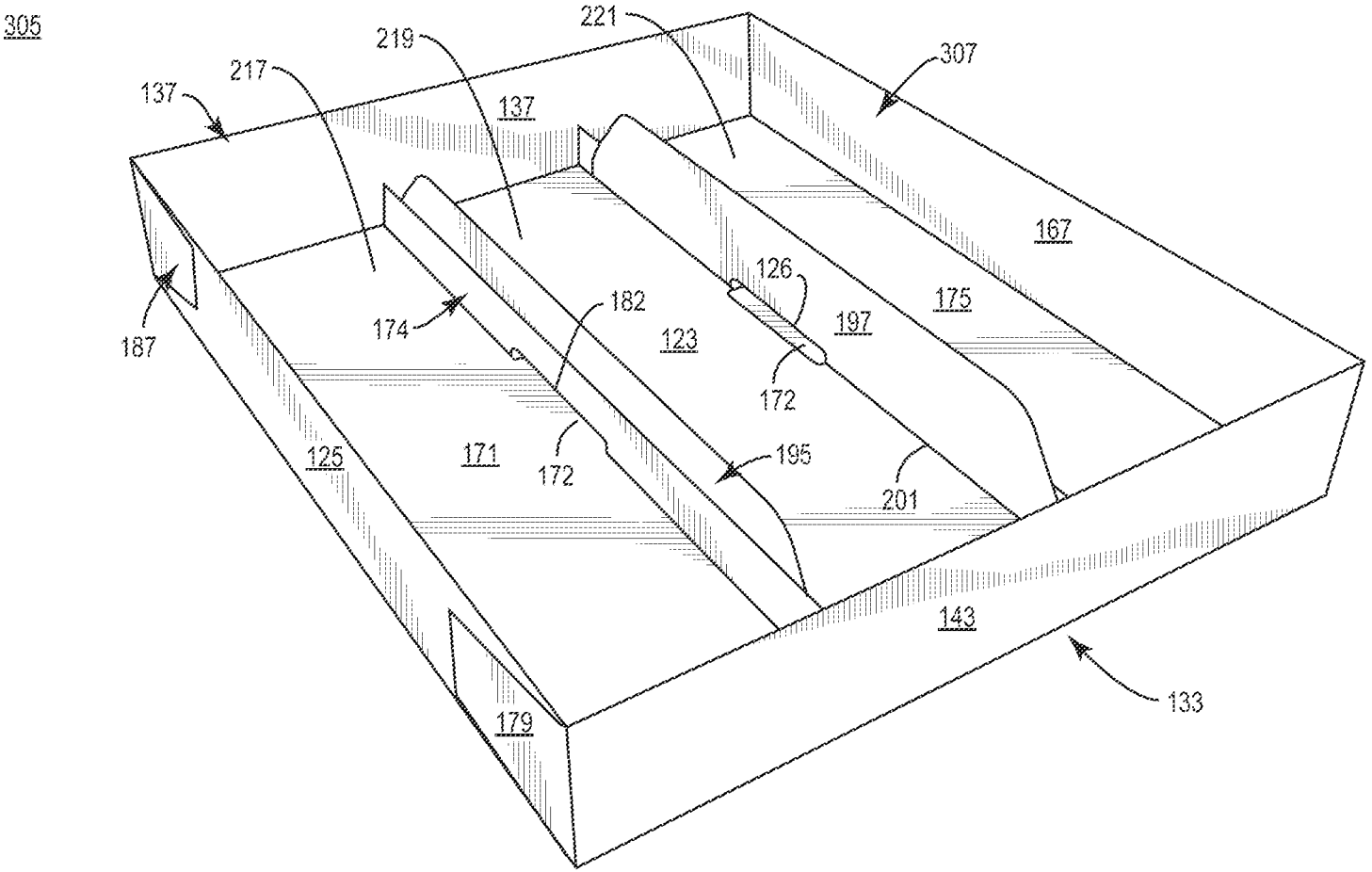
FIG. 5 is a perspective view of a tray formed from the blank of FIG. 4 according to the second exemplary embodiment of the disclosure.
Figure 6:
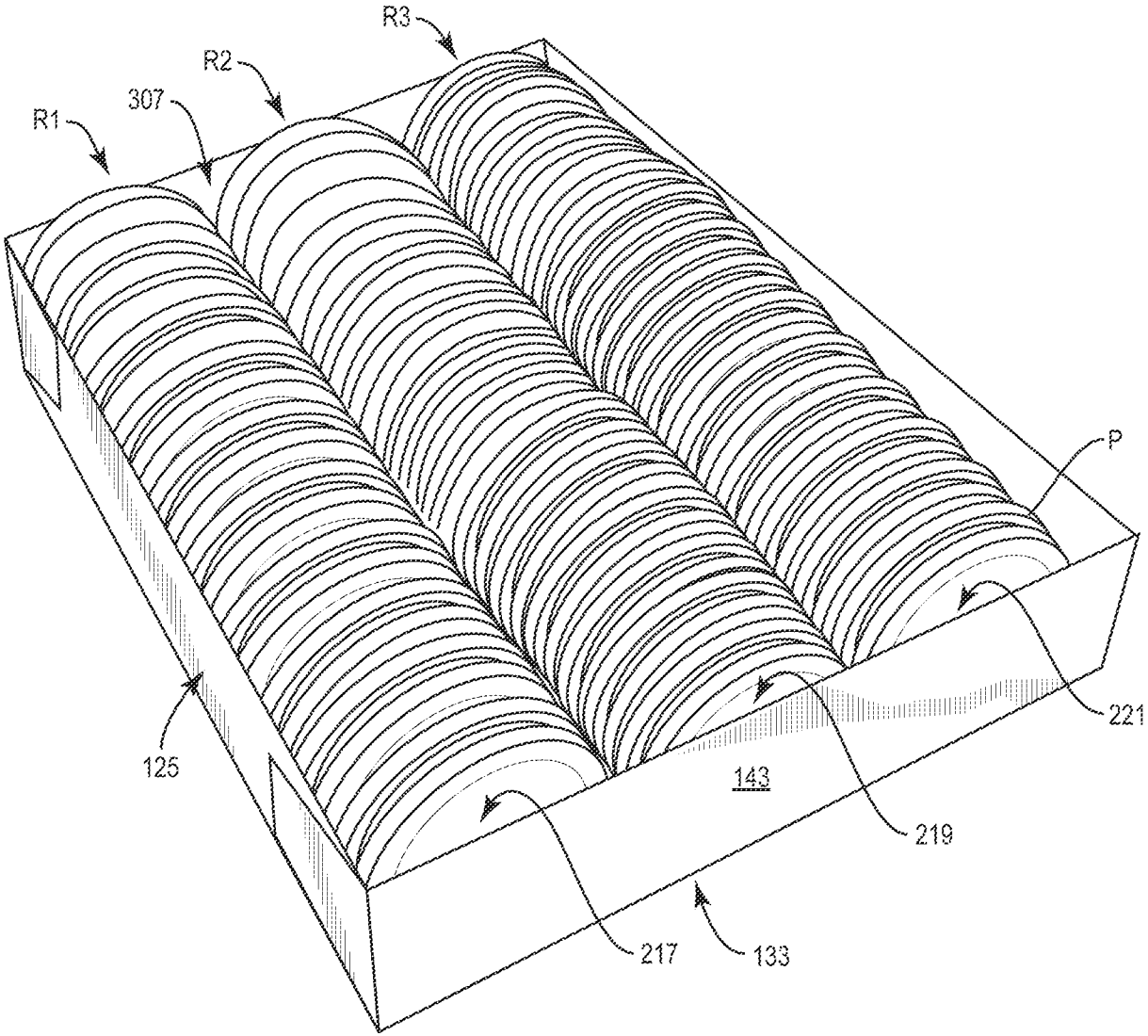
FIG. 6 is a perspective view of the tray of FIG. 5 including a plurality of food products.

Turning to FIG. 4, the exterior surface 301 of a blank 303 for forming a tray 305 (FIG. 5) according to a second exemplary embodiment of the disclosure is illustrated. The blank 303 and tray 305 formed therefrom can have one or more features that are the same or similar to those described above with regard to the blank 103 and tray 105 of the first exemplary embodiment of the disclosure, and like or similar features are designated with like or similar reference numerals.

As shown, the blank 303 and tray 305 formed therefrom can have the bottom panel 123, the divider panels 195, 197, the side panels 125, 129, the side reinforcement panels 163, 167, the side end flaps 171, 175, and associated features. The blank 303 and tray 305 formed therefrom can also have the side end flaps 179, 183, 187, 191 and associated features, and the end flaps 135, 137, except that the end flaps 135, 137 can be devoid of corner portions.

The blank 303 and tray 305 formed therefrom can also include locking features for at least partially maintaining an erected configuration of the tray 305.

In the illustrated embodiment, the locking features can include a respective pair of locking cuts 124 interrupting the respective fold lines 199, 201 to which the respective divider panels 195, 197 are foldably connected to the bottom panel 123. As described further herein, the locking cuts 124 are for forming locking openings 126 (broadly, respective "first locking opening" and "second locking opening") when the tray 305 is formed from the blank 303.

The locking features can also include respective locking tabs 172 (broadly, respective "first locking tab" and "second locking tab") protruding/extending from the respective side end flaps 171, 175 and for being at least partially received in the respective locking openings 126 when the tray 305 is formed from the blank 303.

As also shown, the blank 303 and tray 305 formed therefrom can include respective locking end flaps 174, 176 foldably connected to the respective side end flaps 171, 175 at respective lateral fold lines 178, 180 interrupted by respective generally bracket-shaped cuts 182 that at least partially define the respective locking tabs 172. In some embodiments, the locking tabs 172 can extend from the respective side end flaps 171, 175 without the presence of the locking end flaps 174, 176.

With additional reference to FIGS. 13 and 14, the tray 305 can be formed from the blank 303 in a manner generally similar to that described above with respect to the formation of the tray 105 from the blank 103.

Upon folding of the divider panels 195, 197 at the respective fold lines 199, 201 in the manner described above with respect to the tray 105, respective portions of the bottom panel 123 can separate from the respective divider panels 195, 197 at the respective cuts 124 to form the respective locking openings 126.

Upon positioning of the respective side panels 125, 129, the side reinforcement panels 163, 167, and side end flaps 171, 175 in the manner described above with respect to the tray 105, the respective locking tabs 172 can be positioned to at least partially extend through the respective locking openings 126 (e.g., the locking openings 126 at least partially receive the respective locking tabs 172) to at least partially maintain the erected configuration of the tray 305.

In some embodiments, the locking end flaps 174, 176 can be folded upwardly at the respective fold lines 178, 180 into at least partial face-to-face contact with the respective divider panels 195, 197. In this regard, the locking end flaps 174, 176 can position the respective locking tabs 172 extending therefrom as well as contributing to the division of the interior 307 of the tray 305 into the respective compartments 217, 219, 221 in cooperation with the divider panels 195, 197.

The blank 303 and tray 305 formed therefrom can thus provide a tray with divider features having advantages similar to those described above with respect to the blank 103/tray 105, with the addition of locking features for at least partially maintaining a formed or erected configuration of the tray 305.

In general, the blanks described herein may be constructed from paperboard having a caliper so that it is heavier and more rigid than ordinary paper. The blanks can also be constructed of other materials, such as cardboard, sheet plastics or any other material having properties suitable for enabling the container to function at least generally as described above. The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the container embodiments. The term "glue" is intended to encompass all manner of adhesives commonly used to secure container panels in place, and is not intended to exclude heat, chemical, or frequency bonding techniques.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A tray for holding one or more articles, the tray comprising:

a plurality of panels extending at least partially around an interior space of the tray, the plurality of panels comprising a bottom panel, at least one side panel, and at least one end panel;

a plurality of end flaps foldably connected to a respective panel of the plurality of panels and comprising at least one side end flap, the at least one side end flap in at least partial face to face contact with the bottom panel; and divider features forming a plurality of compartments in the interior space of the tray, the divider features comprising at least one divider panel foldably connected to the bottom panel and at least partially separated from the bottom panel, the at least one side end flap in contact with the at least one divider panel.

2. The tray of claim 1, wherein the at least one divider panel is generally upright relative to the bottom panel.

3. The tray of claim 2, wherein the plurality of panels further comprises at least one side reinforcement panel in at least partial face-to-face contact with the at least one side panel.

4. The tray of claim 2, wherein the at least one side panel is a first side panel, the at least one end panel is a first end panel, the plurality of panels further comprises a second side panel and a second end panel, the at least one divider panel is a first divider panel, and the divider features further comprise a second divider panel foldably connected to the bottom panel and at least partially separated from the bottom panel.

5. The tray of claim 4, wherein the plurality of compartments comprises a first compartment at least partially defined between the first divider panel and the first side panel, a second compartment at least partially defined between the first divider panel and the second divider panel, and a third compartment at least partially defined between the second divider panel and the second side panel.

6. The tray of claim 5, wherein the plurality of panels further comprises a first side reinforcement panel in at least partial face-to-face contact with the first side panel, and the plurality of panels further comprises a second side reinforcement panel in at least partial face-to-face contact with the second side panel.

7. The tray of claim 6, wherein the at least one side end flap is a first side end flap in at least partial face-to-face contact with the bottom panel and the plurality of end flaps further comprises a second side end flap in at least partial face-to-face contact with the bottom panel.

8. The tray of claim 7, further comprising locking features for at least partially maintaining an erected configuration of the tray, the locking features comprising a first locking tab extending from the first side end flap, a second locking tab extending from the second side end flap, a first locking opening defined in the first divider panel, and a second locking opening defined in the second divider panel, the first locking opening at least partially receiving the first locking tab, the second locking opening at least partially receiving the second locking tab.

9. The tray of claim 8, wherein the plurality of end flaps further comprises a first locking end flap foldably connected to the first side end flap and a second locking end flap foldably connected to the second side end flap, the first locking end flap in at least partial face-to-face contact with the first divider panel, the second locking end flap in at least partial face-to-face contact with the second divider panel.

10. The tray of claim 1, further comprising locking features for at least partially maintaining an erected configuration of the tray, the locking features comprising a locking tab extending from the at least one side end flap, the locking features comprising a locking opening defined in the at least one divider panel, the locking opening at least partially receiving the locking tab.

11. The tray of claim 10, wherein the plurality of end flaps further comprises at least one locking end flap foldably connected to the at least one side end flap and in at least partial face-to-face contact with the at least one divider panel.

12. The tray of claim 11, wherein the at least one divider panel is foldably connected to the bottom panel at a fold line interrupted by a cut that forms the locking opening, and the at least one locking end flap is foldably connected to the at least one side end flap at a fold line interrupted by at least one cut that forms the at least one locking tab.

13. The tray of claim 11, wherein a first divider panel is foldably connected to the bottom panel at a fold line interrupted by a cut that forms a first locking opening, a second divider panel is foldably connected to the bottom panel at a fold line interrupted by a cut that forms a second locking opening, a first locking end flap is foldably connected to a first side end flap at a fold line interrupted by a cut that forms a first locking tab, and a second locking end flap is foldably connected to a second side end flap at a fold line interrupted by a cut that forms the second locking tab.

14. A blank for forming a tray for holding one or more articles, the blank comprising:

a plurality of panels for extending at least partially around an interior space of the tray formed from the blank, the plurality of panels comprising a bottom panel, at least one side panel, and at least one end panel;

a plurality of end flaps foldably connected to a respective panel of the plurality of panels and comprising at least one side end flap, the at least one side end flap in at least partial face to face contact with the bottom panel when the tray is formed from the blank; and divider features for forming a plurality of compartments in the interior space of the tray formed from the blank, the divider features comprising at least one divider panel foldably connected to the bottom panel and at least partially separable from the bottom panel, the at least one side end flap in contact with the at least one divider panel when the tray is formed from the blank.

15. The blank of claim 14, wherein the at least one divider panel is for being positioned generally upright relative to the bottom panel.

16. The blank of claim 15, wherein the plurality of panels further comprises at least one side reinforcement panel for being positioned in at least partial face-to-face contact with the at least one side panel when the tray is formed from the blank.

17. The blank of claim 15, wherein the at least one side panel is a first side panel, the at least one end panel is a first end panel, the plurality of panels further comprises a second side panel and a second end panel, the at least one divider panel is a first divider panel, and the divider features further comprise a second divider panel foldably connected to the bottom panel and at least partially separable from the bottom panel.

18. The blank of claim 17, wherein the plurality of panels further comprises a first side reinforcement panel for being positioned in at least partial face-to-face contact with the first side panel when the tray is formed from the blank, and the plurality of panels further comprises a second side reinforcement panel for being positioned in at least partial face-to-face contact with the second side panel when the tray is formed from the blank.

19. The blank of claim 18, wherein the a first side end flap for being positioned in at least partial face-to-face contact with the bottom panel when the tray is formed from the blank and the plurality of end flaps further comprises a second side end flap for being positioned in at least partial face-to-face contact with the bottom panel when the tray is formed from the blank.

20. The blank of claim 19, further comprising locking features for at least partially maintaining an erected configuration of the tray formed from the blank, the locking features comprising a first locking tab extending from the first side end flap, a second locking tab extending from the second side end flap, a first locking opening defined in the first divider panel, and a second locking opening defined in the second divider panel, the first locking opening for at least partially receiving the first locking tab when the tray is formed from the blank, the second locking opening for at least partially receiving the second locking tab when the tray is formed from the blank.

21. The blank of claim 20, wherein the plurality of end flaps further comprises a first locking end flap foldably connected to the first side end flap and a second locking end flap foldably connected to the second side end flap, the first locking end flap for being positioned in at least partial face-to-face contact with the first divider panel when the tray is formed from the blank, the second locking end flap for being positioned in at least partial face-to-face contact with the second divider panel when the tray is formed from the blank.

22. The blank of claim 14, further comprising locking features for at least partially maintaining an erected configuration of the tray formed from the blank, the locking features comprising a locking tab extending from the at least one side end flap, the locking features comprising a locking opening defined in the at least one divider panel, the locking opening for at least partially receiving the locking tab when the tray is formed from the blank.

23. The blank of claim 22, wherein the plurality of end flaps further comprises at least one locking end flap foldably connected to the at least one side end flap and for being positioned in at least partial face-to-face contact with the at least one divider panel when the tray is formed from the blank.

24. The blank of claim 23, wherein the at least one divider panel is foldably connected to the bottom panel at a fold line interrupted by a cut that forms the locking opening, and the at least one locking end flap is foldably connected to the at least one side end flap at a fold line interrupted by at least one cut that forms the at least one locking tab.

25. The blank of claim 23, wherein a first divider panel is foldably connected to the bottom panel at a fold line interrupted by a cut that forms a first locking opening, a second divider panel is foldably connected to the bottom panel at a fold line interrupted by a cut that forms a second locking opening, a first locking end flap is foldably connected to a first side end flap at a fold line interrupted by a cut that forms a first locking tab, and a second locking end flap is foldably connected to a second side end flap at a fold line interrupted by a cut that forms the second locking tab.

26. A method of forming a tray for holding one or more articles, the method comprising:

obtaining a blank comprising a plurality of panels comprising a bottom panel, at least one side panel, and at least one end panel, a plurality of end flaps foldably connected to a respective panel of the plurality of panels and comprising at least one side end flap, and divider features comprising at least one divider panel foldably connected to the bottom panel and at least partially separably from the bottom panel;

positioning the plurality of panels extending at least partially around an interior space of the tray;

at least partially separating the at least one divider panel from the bottom panel to form a plurality of compartments in the interior space of the tray; and positioning the at least one side end flap to form an at least partial face to face contact with the bottom panel, the at least one side end flap in contact with the at least one divider panel.

27. The method of claim 26, wherein positioning the plurality of panels comprises positioning the at least one divider panel generally upright relative to the bottom panel.

28. The method of claim 27, wherein the plurality of panels further comprises at least one side reinforcement panel, and positioning the plurality of panels comprises positioning the at least one side reinforcement panel in at least partial face-to-face contact with the at least one side panel.

29. The method of claim 27, wherein the at least one side panel is a first side panel, the at least one end panel is a first end panel, the plurality of panels further comprises a second side panel and a second end panel, the at least one divider panel is a first divider panel, the divider features further comprise a second divider panel foldably connected to the bottom panel and at least partially separable from the bottom panel, and the method further comprises at least partially separating the second divider panel from the bottom panel.

30. The method of claim 29, wherein the plurality of compartments comprises a first compartment at least partially defined between the first divider panel and the first side panel, a second compartment at least partially defined between the first divider panel and the second divider panel, and a third compartment at least partially defined between the second divider panel and the second side panel.

31. The method of claim 30, wherein the plurality of panels further comprises a first side reinforcement panel and a second side reinforcement panel, and the method further comprises positioning the first side reinforcement panel in at least partial face-to-face contact with the first side panel and positioning the second side reinforcement panel in at least partial face-to-face contact with the second side panel.

32. The method of claim 31, wherein a first side end flap and the plurality of end flaps further comprises a second side end flap, and the method further comprises positioning each of the first side end flap and the second side end flap in at least partial face-to-face contact with the bottom panel.

33. The method of claim 32, wherein the blank further comprises locking features comprising a first locking tab extending from the first side end flap, a second locking tab extending from the second side end flap, a first locking opening defined in the first divider panel, and a second locking opening defined in the second divider panel, and the method further comprises at least partially inserting the first locking tab in the first locking opening and at least partially inserting the second locking tab in the second locking opening to at least partially maintain an erected configuration of the tray.

34. The method of claim 33, wherein the plurality of end flaps further comprises a first locking end flap foldably connected to the first side end flap and a second locking end flap foldably connected to the second side end flap, the method further comprises positioning the first locking end flap in at least partial face-to-face contact with the first divider panel, and the method further comprises positioning the second locking end flap in at least partial face-to-face contact with the second divider panel.

35. The method of claim 26, wherein the blank further comprises locking features comprising a locking tab extending from the at least one side end flap and a locking opening defined in the at least one divider flap, and the method further comprises at least partially inserting the locking tab through the locking opening to at least partially maintain an erected configuration of the tray.

36. The method of claim 35, wherein the plurality of end flaps further comprises at least one locking end flap foldably connected to the at least one side end flap, and the method further comprises positioning the at least one locking end flap in at least partial face-to-face contact with the at least one divider panel.

37. The method of claim 36, wherein the at least one divider panel is foldably connected to the bottom panel at a fold line interrupted by a cut that forms the locking opening, and the at least one locking end flap is foldably connected to the at least one side end flap at a fold line interrupted by at least one cut that forms the at least one locking tab.

38. The method of claim 36, wherein a first divider panel is foldably connected to the bottom panel at a fold line interrupted by a cut that forms a first locking opening, a second divider panel is foldably connected to the bottom panel at a fold line interrupted by a cut that forms a second locking opening, a first locking end flap is foldably connected to a first side end flap at a fold line interrupted by a cut that forms a first locking tab, and a second locking end flap is foldably connected to a second side end flap at a fold line interrupted by a cut that forms the second locking tab.

* * * * *